United States Patent [19]

Steimer

[11] Patent Number: 4,474,554

[45] Date of Patent: Oct. 2, 1984

[54] PROCESS AND AN APPARATUS FOR EVENING OUT THE TEMPERATURES WITHIN THE PREHEATING ZONE OF A KILN

[76] Inventor: Franz Steimer, Unterfeldstrasse 11, 8900 Augsburg, Fed. Rep. of Germany

[21] Appl. No.: 398,665

[22] Filed: Jul. 15, 1982

[30] Foreign Application Priority Data

Aug. 14, 1981 [DE] Fed. Rep. of Germany ..... 3132186

[51] Int. Cl.[3] ..... F27B 9/02; F23D 1/02

[52] U.S. Cl. ..... 432/130; 110/262; 110/264; 431/284

[58] Field of Search ..... 432/130, 133; 110/262, 110/264; 431/284

[56] References Cited

U.S. PATENT DOCUMENTS

| | | | |
|---|---|---|---|
| 1,953,090 | 4/1934 | Vroom | 110/262 |
| 2,044,296 | 6/1936 | Hardgrove | 431/284 |
| 2,692,642 | 10/1954 | Leach | 110/262 |
| 3,108,351 | 10/1963 | Hermans | 432/133 |
| 3,147,795 | 9/1964 | Livingston et al. | 431/284 |
| 3,172,647 | 3/1965 | Remmey | 432/133 |
| 3,822,654 | 7/1974 | Ghelfi | 110/260 |
| 4,030,889 | 6/1977 | Gunnell | 110/262 |
| 4,333,405 | 6/1982 | Michelfelder et al. | 110/264 |
| 4,377,978 | 3/1983 | Eusner | 110/262 |

*Primary Examiner*—Henry C. Yuen

*Attorney, Agent, or Firm*—Collard, Roe & Galgano

[57] ABSTRACT

In the preheating zone of a ceramic tunnel kiln, a smooth increase in the charge temperature over the full kiln cross-section and, for this reason, a high speed of throughput of goods through the kiln, may be produced by mixing up and heating the kiln gases by at least one flameless hot gas jet forced into the preheating zone of the tunnel kiln. This measure furthermore makes it possible for the heat or thermal balance of a tunnel kiln to be made better.

2 Claims, 3 Drawing Figures

PROCESS AND AN APPARATUS FOR EVENING OUT THE TEMPERATURES WITHIN THE PREHEATING ZONE OF A KILN

BACKGROUND OF THE INVENTION

The present invention is with respect to a process for evening out the temperatures in the upper and lower parts of a charge in the preheating part of a ceramic tunnel kiln by causing thorough mixing of the kiln gases. Furthermore, the invention is with respect to an apparatus which may be used for undertaking the process.

If no special steps are taken with respect to heat transfer in the preheating zone so that such transfer is only caused by the draft in the kiln, there will be, as has been seen from experience, a difference of commonly 300° C. between the temperatures in the top and lower kiln charge. It is only at the start of the firing or burning zone that there is a direct firing effect producing an equal temperature over the full kiln cross-section, this being responsible, in turn, for the temperature at the lower part of the charge and at the inlet end of the firing zone being very much more quickly increased than the temperature in the top part of the charge. The outcome may commonly be damage such as thermal cracking or the like of the goods in the lower part of the charge which are to be fired. On the other hand, the goods forming the top part of the charge, do not, as a rule, undergo such damage.

Although attempts have been made at taking care of this shortcoming by aspirating the kiln gases from the top of the preheating zone and then blowing them back into the lower part of the kiln, such circulation, while causing a certain mixing and temperature-evening effect, only makes for a temperature level which is at an average temperature value between the lowest and highest temperatures of the kiln gases mixed together. For this reason, as a rule, the temperatures likely to be produced are not high enough for stopping damage to the goods to be fired at the inlet end of the firing zone because of heating up therein taking place over-quickly. For this reason, the throughput rate has to be lowered if no waste is to be produced. The outcome of this is, however, that the profit produced on working the kiln will be cut back.

GENERAL OUTLINE OF THE PRESENT INVENTION

For this reason, one first purpose of the present invention is that of overcoming undesired effects as produced in known systems by using a simple and, for this reason, low price apparatus for running a process of the sort named at the start which, even on running the kiln with a high throughput rate, at the junction between the preheating zone and the firing zone makes for a smooth increase in the charge temperature right over the full cross-section of the kiln and, for this reason, gives a high financial return.

A still further purpose of the present invention is that of designing an apparatus for use in the process of the invention which is simple and which does not make for a bad heat balance or thermal balance in the tunnel kiln.

The part of the invention's purpose in connection with the process may be effected in a surprisingly simple manner if the kiln gases are completely mixed by at least one flameless hot gas jet running into the tunnel kiln in the preheating zone and the kiln gases are heated thereby.

The hot gas jets, directed into the space inside the kiln, make for a venturi effect causing circulation so that the amount of kiln gases swirled by such jet is many times greater than the volume of the jets themselves. Because of the powerful turbulence produced by the hot gas jets in the kiln space, the kiln gases, making their way through the kiln in a direction opposite to the direction of motion of the goods to be fired, of all temperature ranges are strongly and completely mixed. At the same time, there is a strong mixing between the hot gases and the kiln gases. The steps taken in the invention are, for this reason, responsible for a circulation and complete mixing of the kiln gases while at the same time causing the input of further energy and are responsible, in a very useful way, not only for an evening out of the temperature, but furthermore for an increase in the temperature, that is to say over the full cross-section of the kiln so that the throughput speed may be increased and an increase in quality is likely, because the powerful mixing effect of the invention and heating up in the preheating zone, the increase in temperature takes place generally smoothly at the point where the goods go into the firing zone.

Nevertheless, the thermal balance of the kiln generally is not made any less good, because less heating effect has to be undertaken by the firing zone coming after the preheating zone in which there is an input of energy. The flameless hot gases make an open flame in the kiln space unnecessary, as a further useful effect. The danger of hot spots on the goods to be fired because of the effects of radiation is, for this reason, unlikely, as a further useful effect. A further good effect produced by the present invention is that, because of the high speeds of the hot gases and the turbulence produced thereby, a very good form of heat transfer to the goods to be fired is made possible, this in turn making possible a high level of use of the power or energy of the kiln gases, there furthermore being a desired effect on the energy balance. By blowing in hot air it is, at the same time, possible to make certain that more "false" (or spurious) air may make its way into the kiln space, this again having a desired effect on temperature control and the degree to which the energy is used.

An apparatus for effecting a further part of the purpose of the invention may be made up of a high speed hot gas producer placed in a hollow in the top wall of the kiln, with a combustion air pipe joined up with an air supply, which is more specially designed so that it may be controlled, and a fuel pipe placed in the middle thereof and joined up with a fuel supply system which is best designed so that it may be controlled, the outlet of the fuel pipe opening into a burning space joined up with the combustion air pipe and which has a nozzle-like outlet piece.

The expansion pressure produced on burning in the burning space is responsible for a high outlet speed of the hot gas produced which itself is responsible for a very good circulation and complete mixing effect of the kiln gases and, at the same time, a good heat transfer to the goods to be fired, the nozzle-like outlet piece giving the useful effect of layering so that there is a very stable flow with jets placed near each other so as to give a high penetration force. At the same time the measures forming part of the invention make certain, as a further useful effect, that no unburned fuel is moved into the kiln space. In fact, it is possible to make certain that the fuel forced into the burning space is completely burned within the same so that the rate of fuel use is lowered and the system is made safer. Producing the hot gas near the nozzle in the burning space makes certain that high temperatures are produced so that, for this reason, many changes may be made on running the apparatus. At the same time, one makes certain that, generally speaking, no ducts are needed for the transport of the hot gases so that there is no loss caused by ducts and no duct wear.

As part of a more specially preferred form of the invention, the burning space may be in a hollow structure able to be slipped onto the combustion air pipe and made of SiC in the form of a bushing, SiC having a high resistance to thermal shock and having the useful property of making possible high burning temperatures in the burning space so that no excess of air is needed for lowering the burning temperature, this giving a useful effect with respect to the stability of burning and at the same time making certain that the flame does not make its way through the outlet piece, that is to say there is no "blowing back" of the flame therethrough. At the same time the bushing forming the burning space may be made generally thin-walled so that not only is less material needed for producing it, but furthermore there is the useful effect of high wall temperatures so that drops of fuel running up against such walls are quickly vaporized and they give a high quality of mixed and complete combustion.

LIST OF FIGURES AND DETAILED ACCOUNT OF WORKING EXAMPLE OF THE INVENTION

Further useful developments of the invention will be seen from the account now to be given of one working example using the figures, and from the claims generally.

Figure 1:
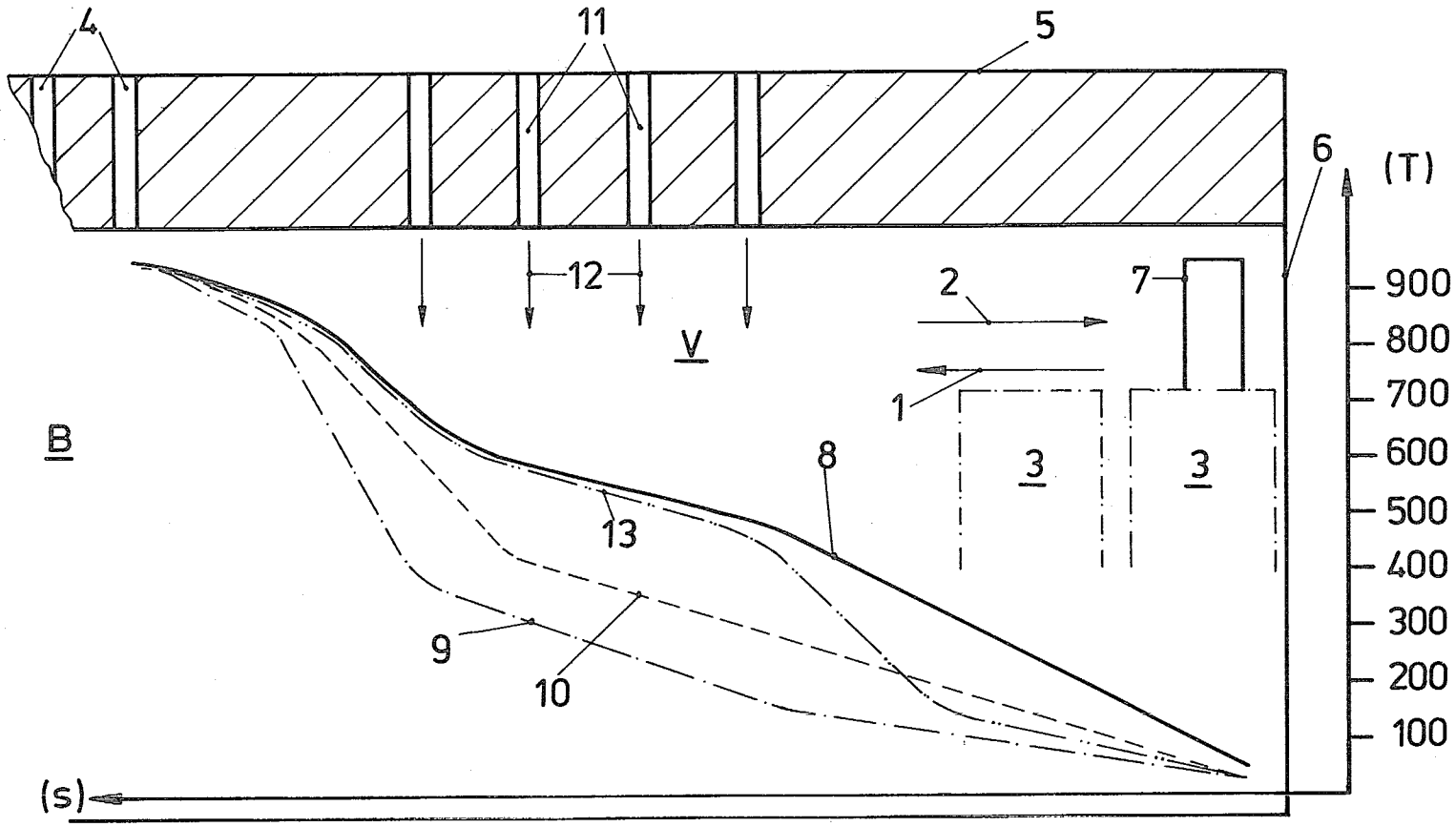
FIG. 1 is a diagrammatic section of part of a tunnel kiln with temperature change curves marked thereon.

The design and workings of a tunnel kiln for firing or burning ceramic goods are well known in the art and there is no need to go into great detail here. Such a tunnel kiln is in effect a counter-current heat exchanger through which the goods to be fired are moved in one direction (marked by arrow 1 in FIG. 1), while in the opposite direction (marked by arrow 2) the flue gases used as a heat vehicle are moved. The goods to be fired are in the form of charge units or parcels 3 which are moved along at an even speed by transport carriages, not to be seen in detail here. The flue gases are produced by burners (of which no details are given here) placed in holes 4 in the top wall 5 of the kiln and such gases are aspirated at the input end 6 of the kiln, for producing the desired draft, by way of aspiration windows 7.

The firing temperature will commonly be of the order of 1000° C., and for heating up the goods moving into the tunnel kiln slowly to this firing temperature, the goods are first moved through a preheating zone V next to the kiln inlet end 6, preheating zone V joining up with a burning or firing zone B in which the full kiln cross-section is acted upon directly by a heating effect so that there is a generally even firing temperature across the full kiln cross-section. At the preheating zone V there is a heating up of the charge units 3 by the flue gases moving towards the aspiration outlet windows 7. Changes in temperature within the goods to be fired in the heating up or preheating zone V are very important with respect to the quality which may be produced with the kiln. More specially, at about 500° C. it has turned out to be very important to keep to certain conditions, that is to say, putting it differently, conditions on being heated up through this range are very frequently the cause for damage to the goods to be fired. In FIG. 1 a number of temperature scales have been marked or plotted along the upright axis against the horizontal axis answering to the length of the preheating zone so as to make clear changes in temperature, as temperature curves, with distance moved to make it clear that there are different temperature changes within the goods to be fired on moving through the heating up of preheating zone V. The temperature curve 8 marked in full lines is the desired temperature curve generally in line with the best possible conditions. The temperature goes up in this respect without any great jumps generally evenly up to the firing zone temperature. The goods are heated up more specially smoothly in the temperature range near 500° C., or putting it differently, the temperature gradient, as a function of time, is very low even at generally high speeds of motion forwards through the kiln so that a very high quality of fired goods will be likely. Such a temperature curve has, in the prior art, so far only been possible in the top ranges of the parcels 3 of goods. In the lower part of the charge parcel or unit 3, there is, because of the natural temperature distribution system over the cross-section not directly acted upon by the burner, of the kiln tunnel in the preheating zone V a temperature curve 9 as marked in broken lines. Between curves 8 and 9 there is, in the middle part of the preheating zone, a very great difference of about 250° to 300° C. The outcome of this is that the lower charge temperature as the charge parcels 3 come towards the firing zone B, that is to say that zone of the kiln which is directly fired, is very quickly increased to the firing temperature, that is to say with a great temperature gradient. Mixing of the flue gases may be responsible for a temperature condition within the complete charge parcels 3 as marked in the broken-line curve 10. In this case as well, as may be clearly seen from FIG. 1, there is a very sharp temperature increase as the parcels 3 of charge come up into the firing zone B.

Figure 2:
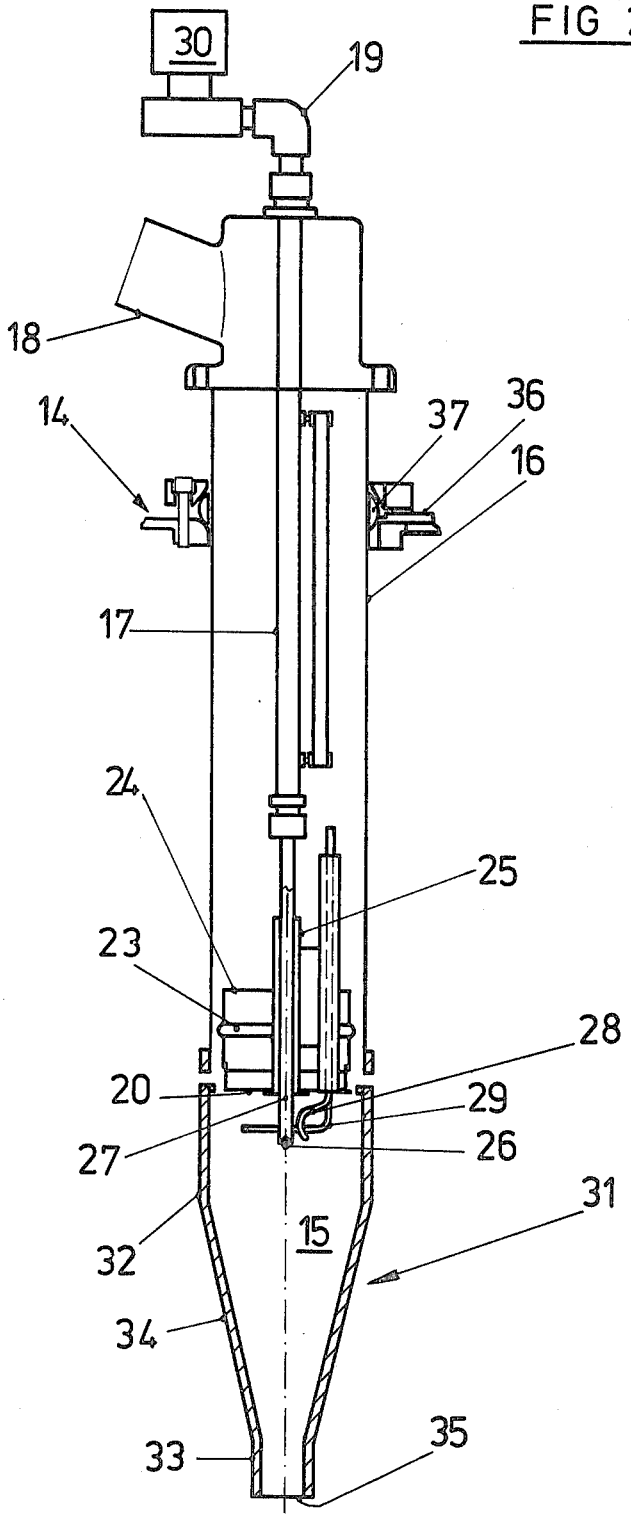
FIG. 2 is a side view and part-section through a high speed hot gas producing unit as used in the invention.

On the face of it, the energy of the flue gases making their way through the preheating zone V is not great enough to make certain of a temperature condition (as marked in curve 8) getting near the best-possible or ideal temperature condition throughout the complete charge parcels 3. To take this into account, it is, for this reason, necessary for the flue gases to be given further energy in the heating zone V and to this end, one or more hot gas producers, of the sort to be seen in more detail in FIG. 2, are placed in the holes 11 in the part of the kiln top wall 5 near the preheating zone, such hot gas producers forcing flameless hot gas jets with a high inlet speed into the space within the kiln as marked by arrows 12 in FIG. 1. These hot gas jets 12 are responsible for a strong mixing and circulation effect with respect to the flue gases coming from the firing zone B so that there is an evening out of the temperature while at the same time increasing the temperature so that within all the charge units or parcels 3 there is a temperature curve 13 as marked in double-chained lines which in the important parts comes very near to the best-possible curve 8. The high velocity hot gas producer generally numbered 14, see FIG. 2, is made up of a casing within which there is combustion space 15, the casing having a nozzle-like outlet piece 33 on being joined up with a combustion air pipe 16 within which there is a fuel pipe 17 opening into the combustion space 15. The combustion air pipe 16 is joined up by way of a union 18 with an air supply unit, for example in the form of a blower. The fuel pipe 17 is joined up by way of a union 19 with a fuel supply unit as for example a fuel pump. For controlling the rates, that is to say metering, of air and fuel, choke valves (not figured) may be placed in the pipes running thereto, such valves' adjustment being undertaken by hand or by way of a servo motor in a way dependent on a temperature reading taken in the preheating zone V. The combustion air pipe 16 and the fuel pipe 17 may be in the form of simple steel tubes and in the working example to be seen in the figure, the fuel pipe 17 is made in two different lengths, the lower length nearest to the combustion space being best made of a steel with very good refractory properties.

Figure 3:
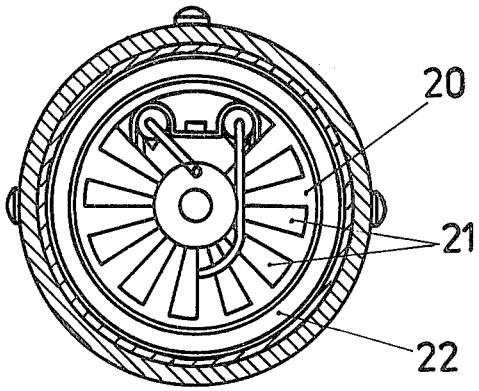
FIG. 3 is a cross-section of the unit at the level of a baffle plate therein.

At the lower end of the combustion air pipe 16 there is a baffle 20 for stopping flame flow-back and at the same time for producing a metered inlet of air into the combustion space 15. Baffle 20 is, as may best be seen from FIG. 3, designed with guide blades 21, at an angle to the direction of air motion so that the air running through between such blades is swirled or turned. The diameter of baffle 20 is a little smaller than the inner diameter of the combustion air pipe 16 so that a ring-like space 22 is produced therebetween for air which is not changed in its flow direction, this being responsible for a specially complete mixing of air and fuel and producing a very high-quality mix or mixture. Baffle 20 is, as furthermore may be seen from FIG. 2, designed with support or positioning bushing 24 (which has a positioning collar 23 thereon and is placed within the combustion air pipe 16) and in the middle is fixed on a bushing 25. Bushing 25 is placed round the fuel pipe 17 running through the baffle 20 for positioning the same.

The end of the fuel pipe 17 nearest to the combustion space 15 is shut off. In the present working example the end of the fuel pipe 17 simply has a weld seam 26. For injection of the fuel the end, running into the combustion space 15, of the fuel pipe 17 has injection holes 27 which are normal to the axis of the pipe. The fuel used may be heating oil, or more specially, natural gas. For ignition of the injected fuel there is an ignition electrode 28. For monitoring combustion there is a flame monitoring electrode 29 acted upon by the ion current produced at high temperatures. As soon as the flame becomes overly small or goes out completely, the signal coming from the flame monitoring electrode 29 will be responsible for cutting off the fuel supply by way of a shut-off valve 30 controlled thereby in the fuel supply pipe. The wires running to the igniting electrode 28 and to the flame monitoring electrode 29 are kept in position by structures on the fuel pipe 17 and placed in guard pipes which are not to be seen in the figure.

The casing of combustion space 15 is in the form of a bush 31, screwed onto the lower end of the combustion air pipe 16. Bush 31 is made of SiC, that is to say a ceramic material which has a very high resistance to thermal shock and a coefficient of thermal expansion nearly equal to zero. This makes it possible for the bush 31 to be thin-walled and because of this the bush material is strongly heated, this effect for its part having a desired effect on the general mix producing system and combustion process. Bush 31 has three parts, that is to say a cylindrical pipe 32 joining with the combustion air pipe 16, a cylindrical outlet nozzle 33 of smaller diameter than the cylindrical part 32, and a coned connection piece 34 between the cylindrical part 32 and the outlet nozzle 33. The cylindrical part 32 gives a large enough combustion space. The outlet nozzle 33 makes certain that the hot gas jet directed into the kiln has a small cross-section and, for this reason, there is a strong mixing effect on the kiln gases. The coned inbetween piece makes certain that there are generally no "flow losses", that is to say in other words, combustion pressure is generally completely turned into kinetic or velocity energy.

In operation the combustion chamber 15 is supplied with air and gas and after ignition there is a complete combustion of the injected fuel in combustion space 15. The pressure produced by such combustion is responsible for a high output speed of the hot gases making their way into the kiln space and at an outlet speed of 150 m to 180 m/sec the hot gas jet forced into the kiln space is responsible for the circulation of an amount of kiln gas equal to many times its own volume so that there is a very high-quality mixing effect. Because combustion itself takes place in combustion space 15, nothing in the kiln space is directly acted upon by the flame so that there is no thermal overloading of the goods to be fired for this reason.

If more than one high speed hot gas producer 14 is used, such producers may be grouped together and joined up with a common air and fuel supply system. Gas producers 14 are so placed in the holes 11 in the roof or top wall of the kiln that the outlet cross-section 35 of the outlet nozzle 33 is generally at the same level as the lower edge of the kiln top wall. For keeping the gas producers 14 in position, support ears 36 may be fixed on the outer combustion air pipe 16 so that they may be rested on the top edge of the kiln top wall. In the present working example support ears 36 are placed round rings 37, with outwardly curved faces to give a sort of ball and socket joint. For this reason, the gas producers may be placed at an angle for getting the desired adjustment of the direction of jets 12.

I claim:

1. Apparatus for causing the upper and lower operating temperatures in the pre-heating zone of a ceramic tunnel kiln to be more uniform by means of at least one high speed hot gas producer placed in an opening in the upper wall of the pre-heating zone of said kiln, said high speed hot gas producer including:

(a) a combustion air pipe coupled to a controllable air supply;

(b) a fuel pipe disposed generally centrally in said combustion air pipe coupled to a controllable fuel supply and having at least one injection bore disposed transversley to the axis of said fuel pipe, the end of said fuel pipe being closed;

(c) a thin walled casing of SiC connected to the free end of said combustion air pipe at a broad cylindrically shaped end of said casing, said broad end being connected to a nozzle-like cylindrical outlet through a converging conically shaped intermediate portion, said casing defining a combustion chamber upstream from said nozzle-like outlet, and said fuel pipe extending into said combustion chamber from said combustion air pipe;

(d) a flame monitoring electrode at the end of the fuel pipe; and (e) at a lower end of the combustion air pipe, said apparatus has a baffle with the fuel pipe running therethrough, said baffle has an outer diameter which is smaller than the inner diameter of the combustion air pipe, whereby the flame produced in said combustion chamber is contained therein and does not exit said nozzle-like outlet.

2. The apparatus as claimed in claim 1, having an ignition electrode at the end of the fuel pipe.

* * * * *